US005524900A

United States Patent [19]

Allen

[11] Patent Number: 5,524,900

[45] Date of Patent: Jun. 11, 1996

[54] BALL REBOUNDING DEVICE

[76] Inventor: Samuel R. Allen, 1120 Woodside Ave., Upland, Pa. 19015-3020

[21] Appl. No.: 450,825

[22] Filed: May 25, 1995

[51] Int. Cl.[6] ..... A63B 69/00

[52] U.S. Cl. ..... 273/396

[58] Field of Search ..... 273/394, 395, 273/396, 397, 411, 26 A, 29 A, 182 R, 181 R, 181 J, 181 K

[56] References Cited

U.S. PATENT DOCUMENTS

| | | | |
|---|---|---|---|
| 4,220,337 | 9/1980 | Moore | 273/395 |
| 4,258,924 | 3/1981 | Ketchum | 273/411 |
| 4,462,599 | 7/1984 | Brown | 273/411 |
| 4,473,227 | 9/1984 | Klaus | 273/26 A |
| 4,948,147 | 8/1990 | Pallanca | 273/402 |
| 5,042,820 | 8/1991 | Ford | 273/395 |
| 5,048,844 | 9/1991 | Haseltine | 273/400 |
| 5,054,791 | 10/1991 | Ball | 273/396 |

*Primary Examiner*—William H. Grieb

[57] ABSTRACT

A ball rebounding device for practicing kicking of a soccer ball. The inventive device includes a rebound panel for receiving an impact from a ball and directing the ball therefrom relative to an angle of incidence of the ball against the rebound panel. An anchor assembly is mounted behind the rebound panel for precluding motion of the rebound panel relative to a ground surface. Lateral guide panels can be coupled to opposed sides of the rebound panel to guide the ball in a desired direction.

7 Claims, 4 Drawing Sheets

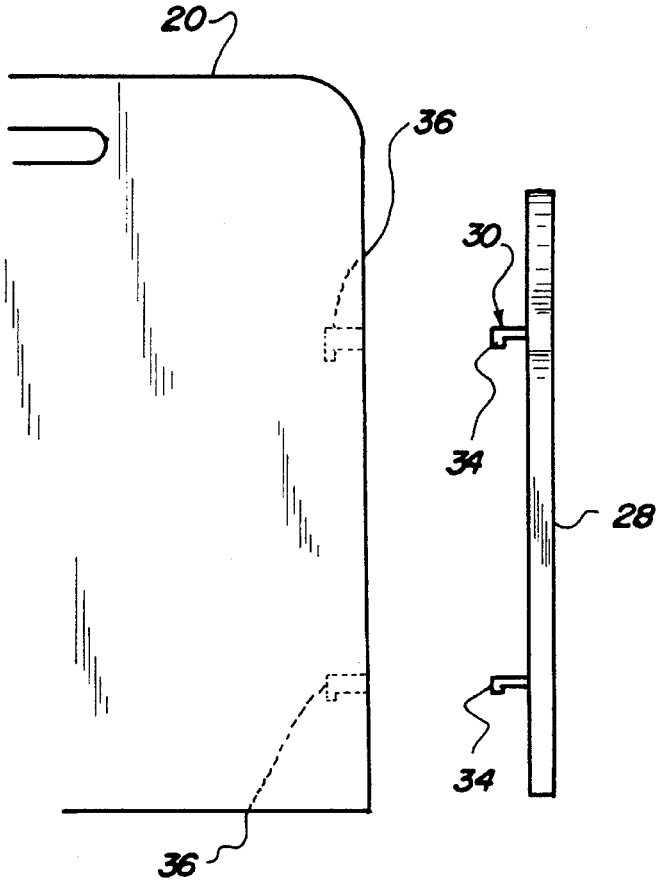
Fig. 3
Fig. 4
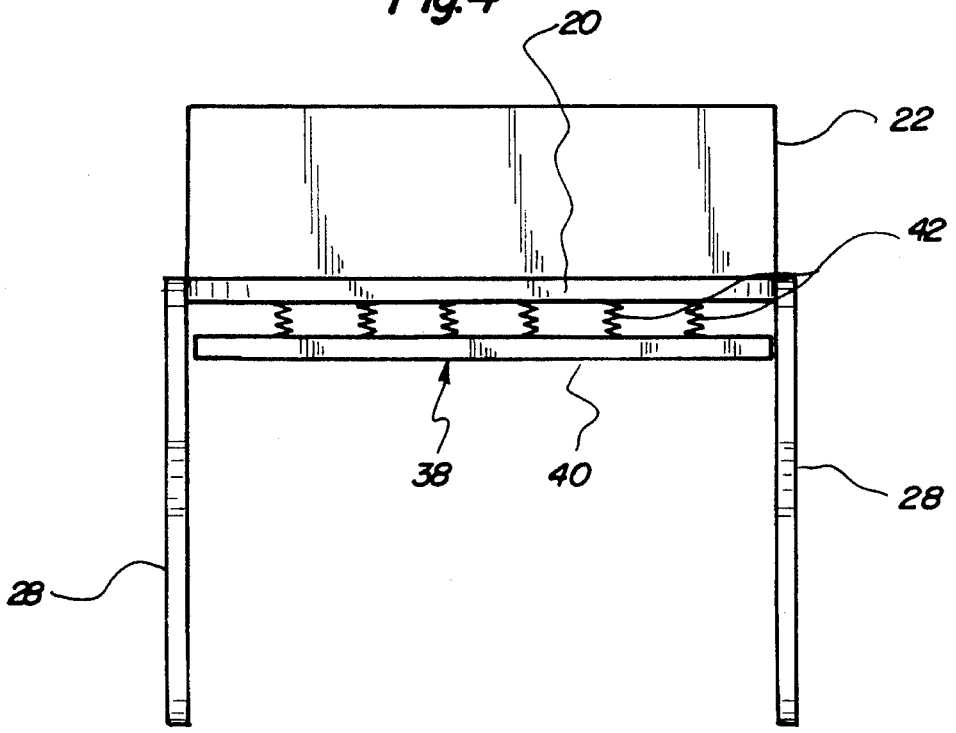

Fig. 7
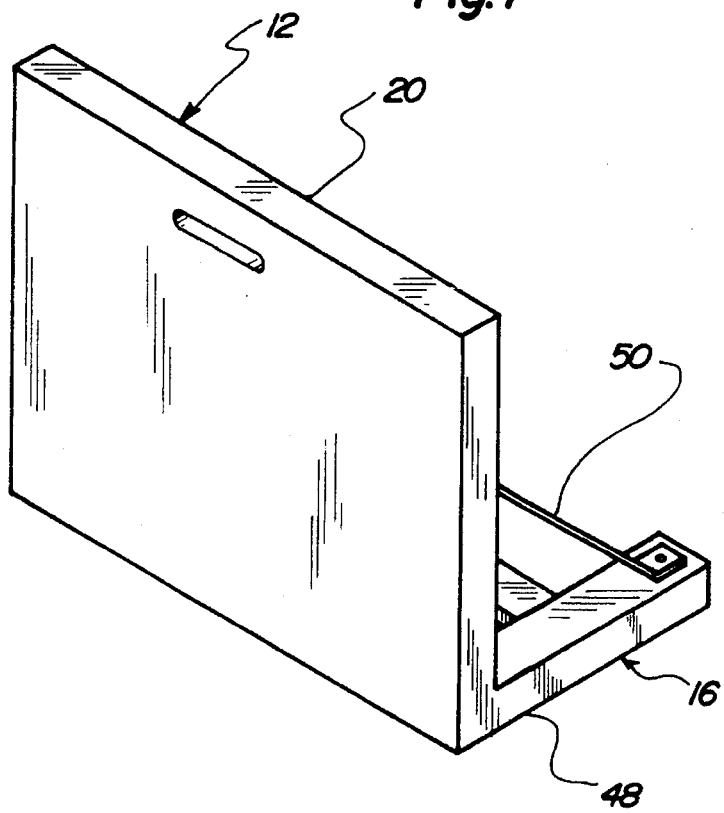
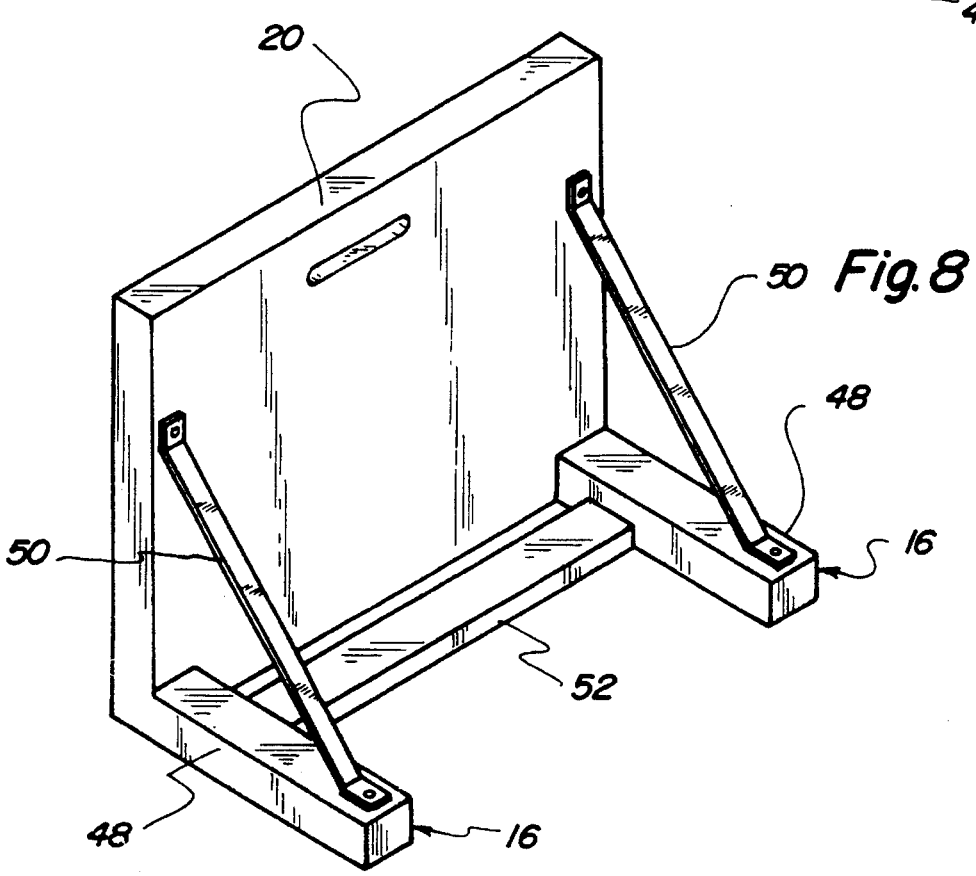
Fig. 8

BALL REBOUNDING DEVICE

BACKGROUND OF THE INVENTION

1. Field of the Invention

The present invention relates to sports practice structures and more particularly pertains to a ball rebounding device for practicing kicking of a soccer ball.

2. Description of the Prior Art

The use of sports practice structures is known in the prior art. More specifically, sports practice structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art sports practice structures include U.S. Pat. Nos. 5,054,791; 5,048,844; 5,042,820; 4,948,147; and 4,462,599.

While these devices fulfill their respective, particular objectives and requirements, the aforementioned patents do not disclose a ball rebounding device for practicing kicking of a soccer ball which includes a rebound means for receiving an impact from a ball and directing the ball therefrom relative to an angle of incidence of the ball against the rebound means, an anchor means mounted behind the rebound means for precluding motion of the rebound means relative to a ground surface, and lateral guide means coupled to opposed sides of the rebound means to guide the ball in a desired direction.

In these respects, the ball rebounding device according to the present invention substantially departs from the conventional concepts and designs of the prior art, and in so doing provides an apparatus primarily developed for the purpose of practicing kicking of a soccer ball.

SUMMARY OF THE INVENTION

In view of the foregoing disadvantages inherent in the known types of sports practice structures now present in the prior art, the present invention provides a new ball rebounding device construction wherein the same can be utilized for practicing kicking of a soccer ball. As such, the general purpose of the present invention, which will be described subsequently in greater detail, is to provide a new ball rebounding device apparatus and method which has many of the advantages of the sports practice structures mentioned heretofore and many novel features that result in a ball rebounding device which is not anticipated, rendered obvious, suggested, or even implied by any of the prior art sports practice structures, either alone or in any combination thereof.

To attain this, the present invention generally comprises a ball rebounding device for practicing kicking of a soccer ball. The inventive device includes a rebound panel for receiving an impact from a ball and directing the ball therefrom relative to an angle of incidence of the ball against the rebound panel. An anchor assembly is mounted behind the rebound panel for precluding motion of the rebound panel relative to a ground surface. Lateral guide panels can be coupled to opposed sides of the rebound panel to guide the ball in a desired direction.

There has rims been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ball rebounding device apparatus and method which has many of the advantages of the sports practice structures mentioned heretofore and many novel features that result in a ball rebounding device which is not anticipated, rendered obvious, suggested, or even implied by any of the prior art sports practice structures, either alone or in any combination thereof.

It is another object of the present invention to provide a new ball rebounding device which may be easily and efficiently manufactured and marketed.

It is a further object of the present invention to provide a new ball rebounding device which is of a durable and reliable construction.

An even further object of the present invention is to provide a new ball rebounding device which is susceptible of a low cost of manufacture with regard to both materials and labor, and which accordingly is then susceptible of low prices of sale to the consuming public, thereby making such ball rebounding devices economically available to the buying public.

Still yet another object of the present invention is to provide a new ball rebounding device which provides in the apparatuses and methods of the prior art some of the advantages thereof, while simultaneously overcoming some of the disadvantages normally associated therewith.

Still another object of the present invention is to provide a new ball rebounding device for practicing kicking of a soccer ball.

Yet another object of the present invention is to provide a new ball rebounding device which includes a rebound means for receiving an impact from a ball and directing the ball therefrom relative to an angle of incidence of the ball against the rebound means, and an anchor means mounted behind the rebound means for precluding motion of the rebound means relative to a ground surface.

Even still another object of the present invention is to provide a new ball rebounding device which further includes lateral guide means coupled to opposed sides of the rebound means to guide the ball in a desired direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded elevational view of a portion of the invention including an alternative coupling means.

FIG. 4 is a top plan view of the invention including a spring plate assembly.

FIG. 7 is a an isometric illustration of a further alternative form of the ball rebounding device according to the present invention.

FIG. 8 is a rear isometric illustration of the device illustrated in FIG. 7.

DESCRIPTION OF THE PREFERRED EMBODIMENT

Figure 1:
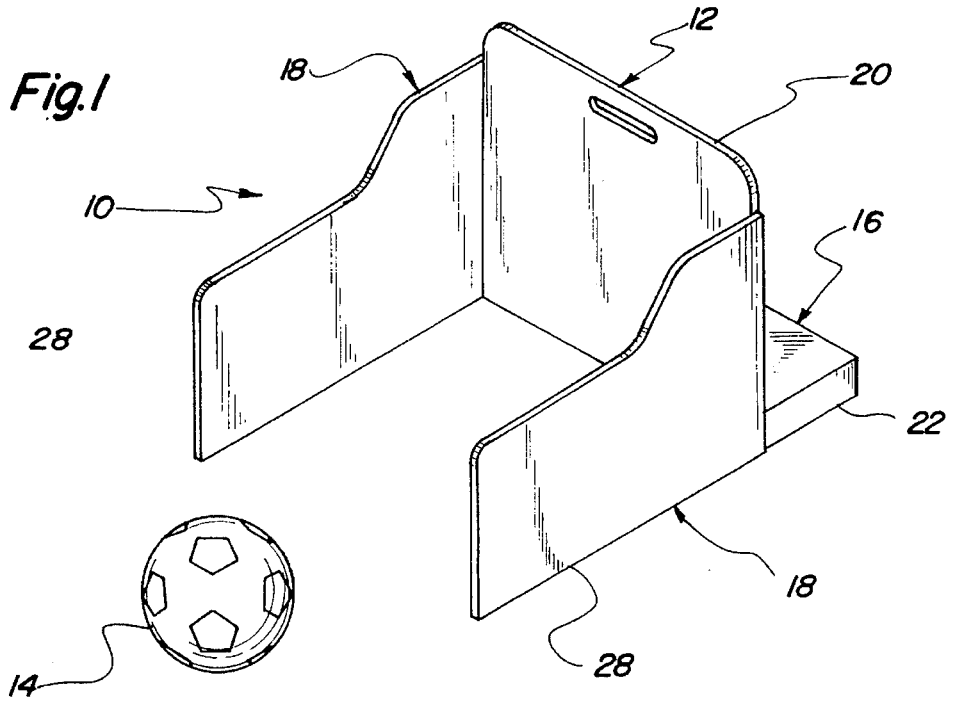
FIG. 1 is an isometric illustration of a ball rebounding device according to the present invention.

With reference now to the drawings, and in particular to FIGS. 1–8 thereof, a new ball rebounding device embodying the principles and concepts of the present invention and generally designated by the reference numeral 10 will be described.

More specifically, it will be noted that the ball rebounding device 10 comprises a rebound means 12 for receiving an impact from a ball 14 and deflecting the ball back towards a kicker at an angle relative to an angle of incidence of the ball against the rebound means. An anchor means 16 is mounted behind the rebound means 12 for positioning the rebound means in a substantially vertical orientation and for securing a position of the rebound means relative to a ground surface. If desired, lateral guide means 18 can be coupled to opposed sides of the rebound means for engaging and guiding the ball in response to impacting of the ball thereagainst. By this structure, an individual may practice a sport such as soccer by repeatedly impacting the ball 14 against the rebound means 12.

As best illustrated in FIG. 1, it can be shown that the rebound means 12 according to the present invention 10 preferably comprises a planar back panel 20 having a substantially planar forward impacting face such that the angle of deflection of the ball 14 when impacted against the planar back panel will equal the angle of impact thereagainst. Thus, an individual impacting the ball 14 in an orthogonal orientation to the planar back panel 20 will receive the ball back at the same angle such that lateral motion of the ball does not occur.

Figure 2:
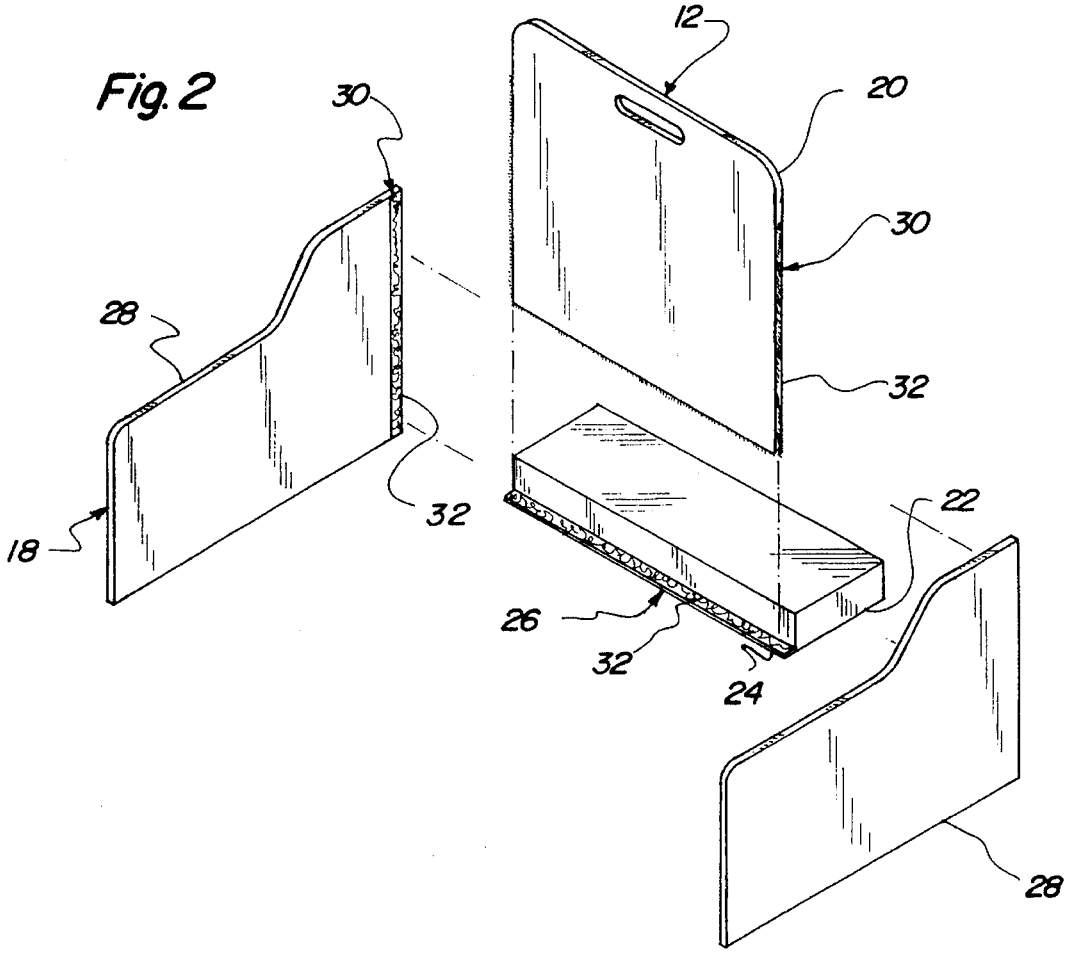
FIG. 2 is an exploded isometric illustration of the present invention.

As shown in FIG. 2, the anchor means 16 preferably comprises a weight 22 positionable upon the ground surface. A flange 24 projecting from the weight 22 receives and engages a lower edge of the planar back panel 20. A weight coupling means 26 extends along the flange and a lower surface of the planar back panel to couple the two components together. By this structure, the present invention 10 can be easily disassembled for transportation and/or storage purposes.

With continuing reference to FIG. 2, it can be shown that the lateral guide means 18 according to the present invention 10 preferably comprises a pair of lateral guide panels removably coupled to respectively opposed lateral edges of the back panel 20 by a lateral panel coupling means 30. Preferably, the coupling means 26 and 30 comprise hook and loop material 32 secured to the respective component parts of the invention. If desired, the coupling means 26 and/or 30 can comprise snaps, buttons, adhesives, threaded fasteners, impact driven fasteners, or other conventionally known fastening means. Alternatively and as shown for the lateral panel coupling means 30 in FIG. 3, the coupling means 26 or 30 may comprise securing pegs 34 projecting into apertures 36 directed into the back panel 20 to provide for the releasably coupling of the components parts together.

As shown in FIG. 4, the present invention 10 may further comprise a spring plate assembly 38 coextensively positioned over the front face of the back panel 20 for providing for improved rebounding of the ball 14 from the rebound means 12. To this end, the spring plate assembly 38 comprises a spring plate 40 supported in a normally spaced and parallel orientation relative to the back panel 20 by a plurality of springs 42 interposed between the spring plate and the back panel 20. The spring plate 40 is thus resiliently suspended relative to the back panel 20 such that impacting of the ball 14 against the spring plate 40 will deform one or more of the springs 42. Such deformation of the springs 42 will store kinetic energy that is subsequently returned to the ball 14 during rebounding thereof from the spring plate assembly 38.

Figure 5:
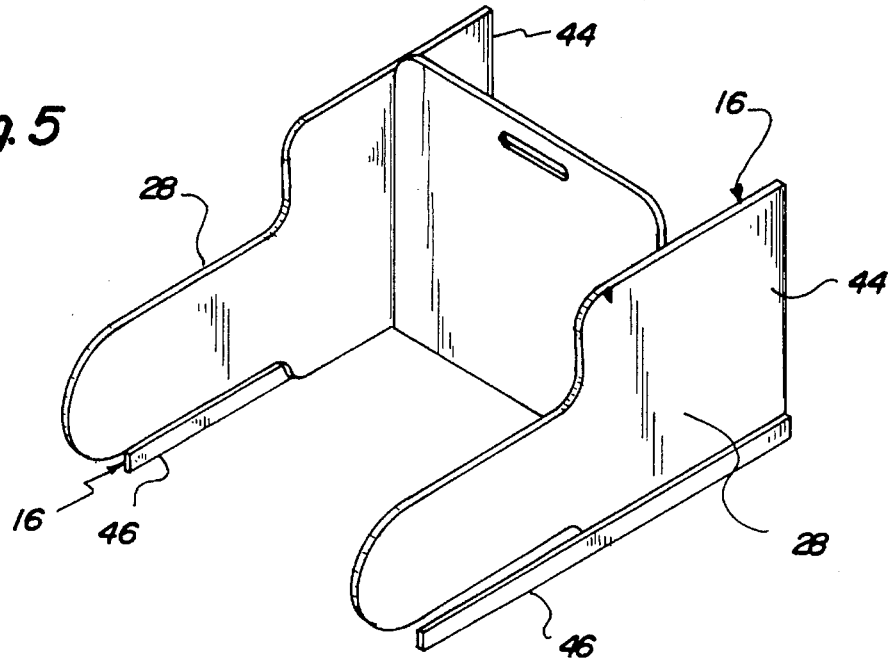
FIG. 5 is an isometric illustration of an alternative form of the ball rebounding device according to the present invention.
Figure 6:
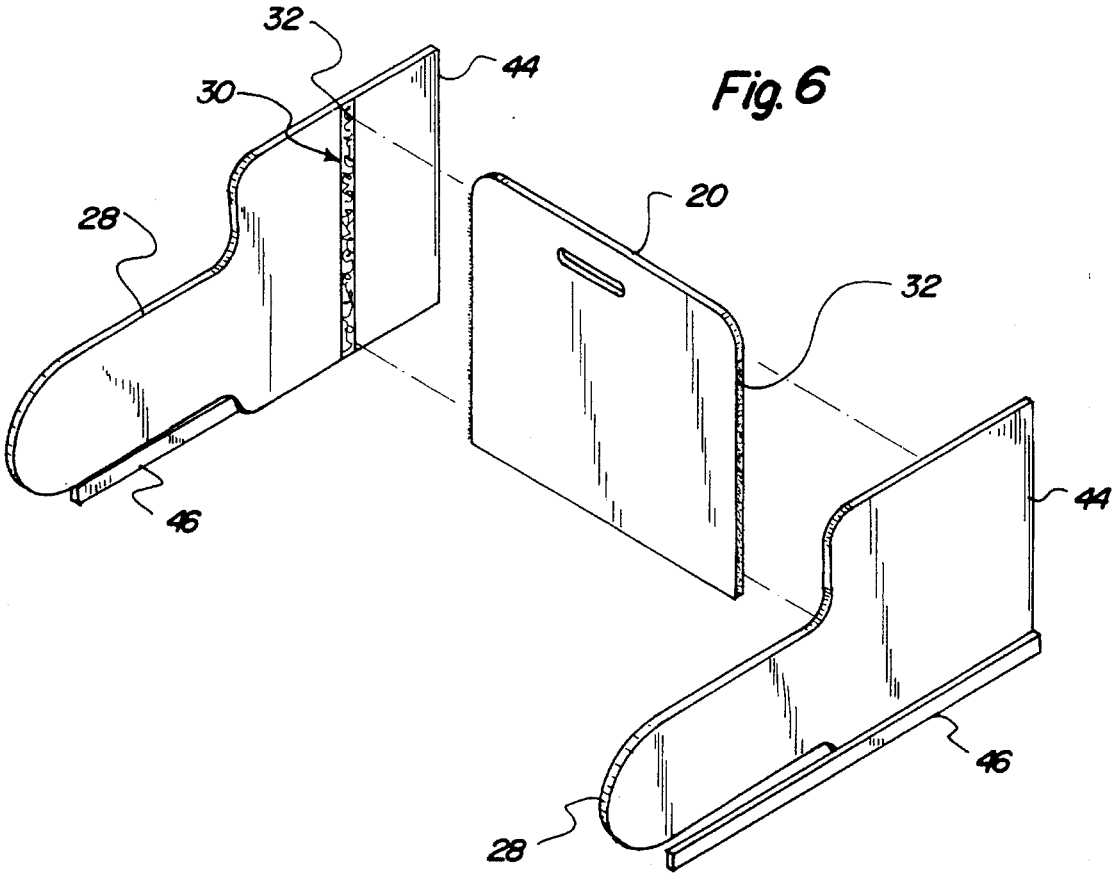
FIG. 6 is an exploded isometric illustration of the device set forth in FIG. 5.

Referring now to FIGS. 5 and 6 wherein an alternative form of the present invention 10 is illustrated, it can be shown that the anchor means, in lieu of the weight 22, may alternatively comprise extension panels 44 projecting rearward of the back panel 20, with elongated legs 46 projecting in a horizontal orientation and forward of the back panel. In this configuration, the extension panels 44 can be integrally formed with the lateral panels 28, and the elongated legs 46 can be secured directly to the lateral panels such that removal of the lateral panels from the back panel 20 effects simultaneous removal of the anchor means 16 from the rebound means 12.

As shown in FIGS. 7 and 8, the present invention 10 may, in its simplest form, include only the rebound means 12 and the anchor means 16. In this further alternative form of the invention 10, the anchor means, in lieu of the weight 22 or the extension panels 44 and elongated legs 46, comprises a pair of rear legs 48 extending rearward of the planar back panel 20, with a pair of brace members 50 extending therebetween. A joiner plate 52 can extend between the rear legs 48, but is typically not needed in construction of the device 10. Suitable friction increasing materials, such as elastomeric feet or the like, can be secured to bottom surfaces of the rear legs 48 to increase frictional adherence of the anchor means 16 to an associated ground surface when positioned thereon.

In use, the ball rebounding device 10 according to the present invention can be easily utilized to effect practicing and training of soccer kicking skills as described above. The various configurations of the device 10 enable customization of the features disclosed herein as desired by an end user. The various coupling means 26 and 30 permit the device 10 to be easily disassembled for transport and storage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the; parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ball rebounding device comprising:

a rebound means for receiving an impact from a ball and deflecting the ball back towards a kicker;

an anchor means mounted behind the rebound means for positioning the rebound means in a substantially vertical orientation and for securing a position of the rebound means relative to a ground surface;

lateral guide means coupled to opposed sides of the rebound means for engaging and guiding a ball in response to impacting of the ball thereagainst;

wherein the rebound means comprises a planar back panel having a substantially planar forward impacting face such that an angle of deflection of a ball when impacted against the planar back panel will equal an angle of impact thereagainst;

wherein the anchor means comprises a weight positionable upon a ground surface, the weight being coupled to the planar back panel; and wherein the anchor means further comprises a flange projecting from the weight which receives and engages a lower edge of the planar back panel; and a weight coupling means extending along the flange and a lower surface of the planar back panel to couple the flange and the weight to the planar back panel.

2. The ball rebounding device of claim 1, wherein the lateral guide means comprises a pair of lateral guide panels removably coupled to respectively opposed lateral edges of the back panel.

3. The ball rebounding device of claim 2, and further comprising a spring plate assembly coextensively positioned over the front face of the back panel for effecting disparate rebounding of the ball from the rebound means.

4. The ball rebounding device of claim 3, wherein the spring plate assembly comprises a spring plate positioned in front of the back panel; and a plurality of springs interposed between the spring plate and the back panel to support the spring plate in a normally spaced and parallel orientation relative to the back panel.

5. A ball rebounding device comprising:

a rebound means for receiving an impact from a ball and deflecting the ball back towards a kicker;

an anchor means mounted behind the rebound means for positioning the rebound means in a substantially vertical orientation and for securing a position of the rebound means relative to a ground surface;

lateral guide means coupled to opposed sides of the rebound means for engaging and guiding a ball in response to impacting of the ball thereagainst;

wherein the rebound means comprises a planar back panel having a substantially planar forward impacting face;

wherein the lateral guide means comprises a pair of lateral guide panels removably coupled to respectively opposed lateral edges of the back panel; and wherein the anchor means comprises extension panels integrally projecting from the lateral panels and rearward of the back panel.

6. The ball rebounding device of claim 5, wherein the extension panels are integrally formed with the lateral panels.

7. The ball rebounding device of claim 5, further including elongated legs projecting from the lateral panels respectively in a horizontal orientation and forward of the back panel.

* * * * *